United States Patent [19]

Mochizuki

[11] Patent Number: 5,072,656

[45] Date of Patent: Dec. 17, 1991

[54] METHOD AND APPARATUS FOR CONTROLLING THE TRANSFER OF TUBULAR MEMBERS INTO A SHELTER

[75] Inventor: David A. Mochizuki, Anchorage, Ak.

[73] Assignee: Nabors Industries, Inc., Houston, Tex.

[21] Appl. No.: 654,237

[22] Filed: Feb. 12, 1991

[51] Int. Cl.[5] ..... F24F 1/02

[52] U.S. Cl. ..... 454/255; 414/217; 454/338

[58] Field of Search ..... 98/1, 1.5, 33.1, 39.1, 98/87; 414/217

[56] References Cited

U.S. PATENT DOCUMENTS

| | | | |
|---|---|---|---|
| Re. 28,101 | 8/1974 | Knorr . | |
| 1,667,738 | 5/1928 | Nichols | 414/217 |
| 3,002,560 | 10/1961 | Paget . | |
| 3,158,211 | 11/1964 | McCue et al. . | |
| 3,626,836 | 12/1971 | Schneidler . | |
| 3,693,729 | 9/1972 | Blurton et al. . | |
| 3,744,259 | 7/1973 | Wagley . | |
| 3,783,627 | 1/1974 | Blurton et al. . | |
| 3,844,126 | 10/1974 | Blurton et al. . | |
| B1 4,478,268 | 4/1991 | Palmer . | |
| 4,613,001 | 9/1986 | Edberg et al. . | |
| 4,618,286 | 10/1986 | Michel et al. . | |

*Primary Examiner*—Harold Joyce

*Attorney, Agent, or Firm*—Arnold, White & Durkee

[57] ABSTRACT

A portable drilling apparatus 10 designed to be used in environmentally severe locations, such as the Arctic, includes provisions for heating various portions thereof, including a pipe shelter 14. The pipe shelter 14 is used to store, warm, and clean the drill pipe and/or casing prior to insertion in the well. Thus, to provide access for loading the drill pipe and/or casing into the pipe shelter 14, a significantly large opening must be provided. The large opening necessarily results in significant infiltration of arctic air and loss of heated air, thereby increasing the difficulty of maintaining the pipe shelter 14 at a comfortable working temperature. Accordingly, a high-speed spool or window-shade style door 38 is employed to seal the opening against large scale transfers of heated and cold air. Further, an indirect fired air-heater 90 having a capacity sufficient to maintain a positive pressure in the pipe shelter 14 is also used. The positive pressure within the pipe shelter 14 causes warm air to exit rapidly when the door 38 is opened, and thereby reduces the inflow of arctic air. Accordingly, the combination of the high-speed door 38 and positive pressure environment within the pipe shelter 14 combine to provide a relatively stable and comfortable temperature environment.

19 Claims, 3 Drawing Sheets

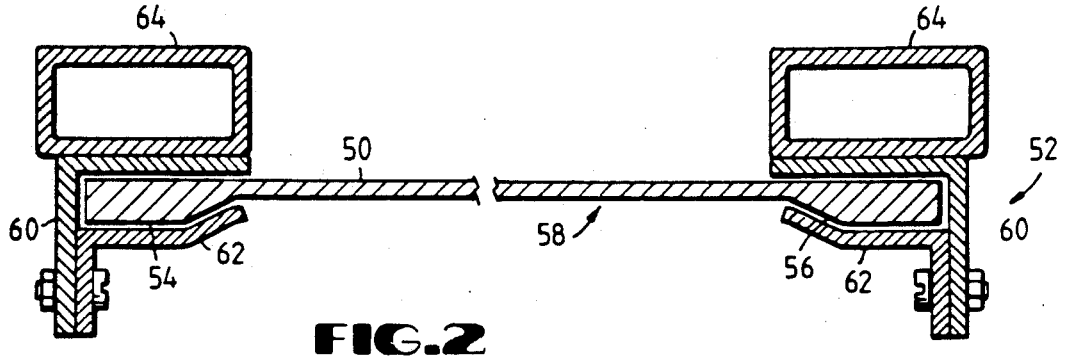
FIG.2
FIG.3
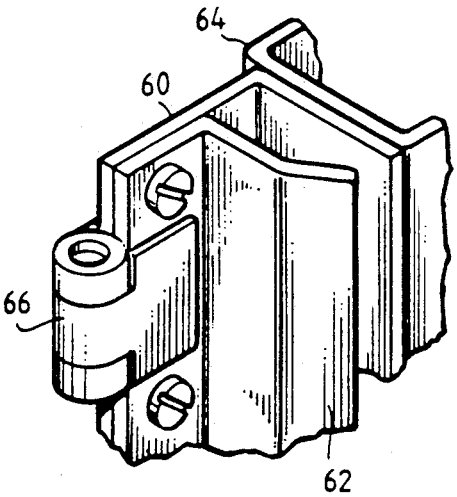
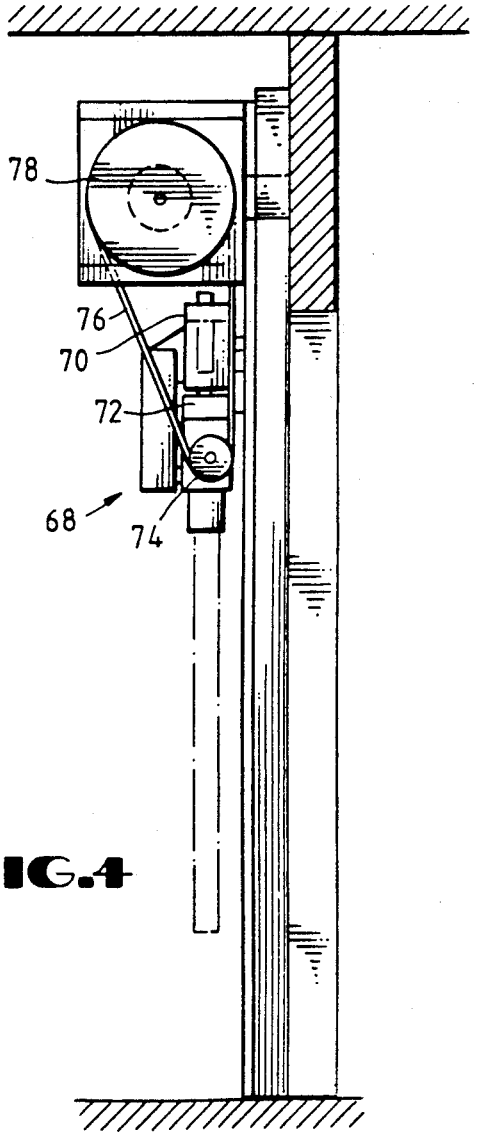
FIG.4

METHOD AND APPARATUS FOR CONTROLLING THE TRANSFER OF TUBULAR MEMBERS INTO A SHELTER

INFORMATION REGARDING RELATED APPLICATIONS

This invention is related to the following applications, all of which are subject to assignment to a common assignee and are concurrently filed herewith "Self-Propelled Drilling Module," Ser. No. 07/655,562;

"Fully Articulating Ramp Extension for Pipe Handling Apparatus," Ser. No. 07/654,898;

"Mobil Drilling Rig for Closely Spaced Well Centers," Ser. No. 07/654,754; and

"Harness Method and Apparatus," Ser. No. 07/654,775.

BACKGROUND OF THE INVENTION

1. Field of the Invention

This invention relates generally to a method and apparatus for use in well drilling equipment, and, more particularly, to a method and apparatus for controlling the loading of drill pipe and/or casing through a door in a pipe shelter of the well drilling equipment.

2. Description of the Related Art

The progress of the industrial era is based, in significant part, on the discovery and useful application of hydrocarbon fuels. Increasing industrialization of the world has lead to corresponding growth in the need for and use of these hydrocarbon fuels. Given a finite supply of hydrocarbon resources, it should be appreciated that the resources that are most readily accessible, and, correspondingly, the least expensive to produce, have been discovered and exploited on a large scale.

As demand for the hydrocarbons increased, so to did the price, thereby encouraging exploration and production into previously economically infeasible areas of the world. For example, rising prices were accompanied by exploration and production from offshore platforms and ships that drilled into the ocean floor. The technical difficulty and attendant expense of such offshore drilling is readily apparent.

Additionally, huge oil reserves have recently been discovered, and production has begun in what is arguably the most severe climate on the planet, the arctic, or the North Slope of Alaska. While the technical difficulties faced in such an environment are far different than those experienced on offshore platforms, they are, nonetheless, severe to the point of rendering equipment commonly used elsewhere useless.

A problematic area, if not the most significant difficulty, in drilling oil wells on the North Slope, is, of course, exposure of the equipment and work force to arctic temperatures. Outdoor temperatures often reach −70° F., whereas minimally comfortable temperatures for the work force begin at more than 100° F. higher. Providing a comfortable work environment is known to dramatically improve the efficiency of the work force.

Further, it is preferred that casing and/or drill pipe used in drilling a well should be substantially free of dirt, ice, snow, etc., especially adjacent their threaded end regions. Ice present on the threads of the pipe and/or casing can cause the threads to be stripped or at least damaged during the connection process. Clearly, removing ice or snow from the pipe and/or casing is significantly easier in a heated environment.

While it is readily possible to heat enclosed structures to such a desirable temperature, the problem lies in the continuous need for large, bulky items to be used in the drilling process, i.e., drill pipe and casing. Accordingly, closed structures associated with the drilling equipment, such as a pipe shelter, are frequently and continuously opened to the elements so that pipe and casing may be loaded therein. The large, bulky nature of the pipe and casing necessitates that the door or opening through which the pipe and casing are loaded must also be large, thereby causing a significant exchange of heated air for arctic air. Thus, the temperature of the pipe shelter is difficult to maintain at a comfortable working temperature.

The present invention is directed to overcoming or at least minimizing one or more of the problems set forth above.

SUMMARY OF THE INVENTION

In one aspect of the present invention, a method is provided for controlling the temperature within a pipe shelter, comprising the steps of: providing an opening in an outer wall of the pipe shelter for ingress and egress therethrough; providing a high-speed spool or window-shade style door in the opening to substantially resist the exchange of air within the pipe shelter with air outside the pipe shelter; and pressurizing the interior of the pipe shelter to a level exceeding outside atmospheric pressure.

In another aspect of the present invention, a method is provided for controlling the temperature within a pipe shelter, wherein the pipe shelter includes an opening in an outer wall of the pipe shelter for delivering material therethrough, and a high-speed spool or window-shade style door in the opening to substantially resist the exchange of air within the pipe shelter with air outside the pipe shelter. The method comprises the steps of: pressurizing the interior of the pipe shelter to a level exceeding outside atmospheric pressure, whereby air interior to the pipe shelter flows through the opening when the door is open, reducing the flow of outside air into the pipe shelter; opening the door at high-speed; delivering material through the opening; closing the door at high-speed.

In another aspect of the instant invention, a method is provided for reducing the inward flow of outside air into a pipe shelter during a transfer of material therein that requires the opening and closing of a door on the pipe shelter. The method comprises the steps of: pressurizing the interior of the pipe shelter with heated air to a level exceeding outside atmospheric pressure; opening the door at high-speed; delivering the material through the opening; and closing the door at high-speed.

In still another aspect of the instant invention, an apparatus is provided for reducing the inward flow of outside air into a pipe shelter during a transfer of material through an opening in the pipe shelter. The apparatus includes a high-speed spool or window-shade style door positioned in the opening and adapted for substantially resisting the exchange of air within the pipe shelter with air outside the pipe shelter. An indirect fired air heater is adapted for periodically heating the air within the pipe shelter. A fan discharge unit is adapted for circulating the heated air at a rate sufficient to produce a positive pressure in the pipe shelter relative to atmospheric pressure outside the pipe shelter. Finally, drive means is coupled to the door and adapted for opening and closing the door at high-speed.

BRIEF DESCRIPTION OF THE DRAWINGS

Other objects and advantages of the invention will become apparent upon reading the following detailed description and upon reference to the drawings in which:

FIG. 2 illustrates a top, cross-sectional view of a door and support assembly on a pipe shelter;

FIG. 3 illustrates a perspective view of a portion of the support assembly for the pipe shelter door;

FIG. 4 illustrates a side, cross-sectional view of the pipe shelter door, support assembly, and drive mechanism.

Figure 1:
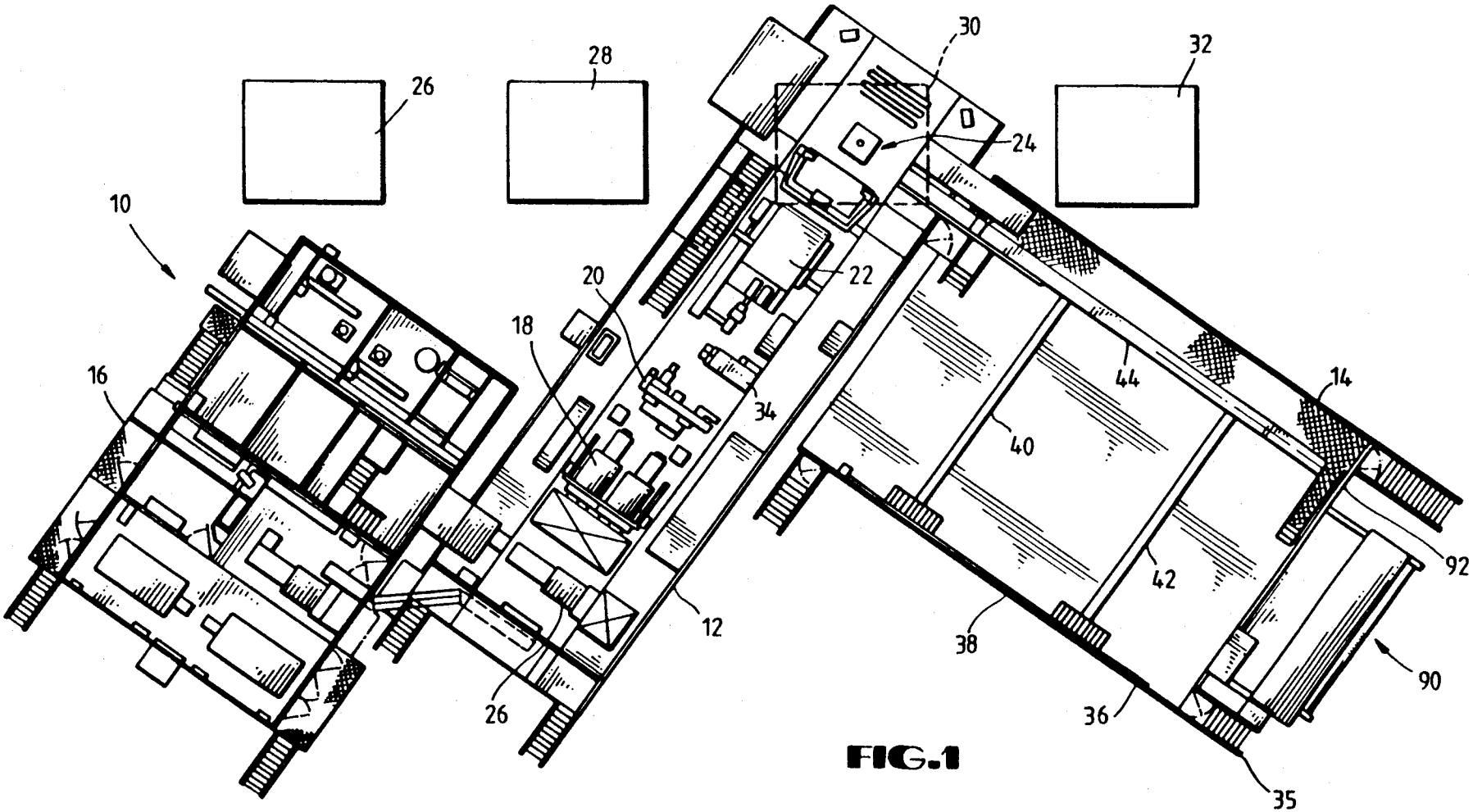
FIG. 1 illustrates a top, partial, cross-sectional view of various modules of a portable well drilling apparatus positioned at a well site.

While the system is susceptible to various modifications and alternative forms, a specific embodiment thereof has been shown by way of example in the drawings and will herein be described in detail. It should be understood, however, that this specification is not intended to limit the invention to the particular form disclosed herein, but on the contrary, the intention is to cover all modifications, equivalents, and alternatives falling within the spirit and scope of the invention, as defined by the appended claims.

DESCRIPTION OF A PREFERRED EMBODIMENT

Referring now to the drawings and, in particular, to FIG. 1, a portable well drilling apparatus 10 is illustrated. The apparatus 10 is composed of three separable modules: a drilling module 12, a pipe shelter 14 and a mud module 16. The drilling module 12 is a self-contained, wheel-type vehicle capable of being driven across relatively smooth terrain. The wheels (not shown) on the drilling module 12 are powered by at least one internal combustion engine 18 through a transmission system 20. Preferably, the internal combustion engine 18 includes a pair of Caterpillar 3408® diesel engines. Thus, the drilling module 12 is capable of self-propelled motion, guided by an operator positioned in a cab (not shown) on the drilling module 12.

The drilling module 12 also includes a conventional drilling rig (not shown) and its attendant support equipment. For example, a drawworks 22 is connected through the transmission system 20 to the internal combustion engines 18 so that the drawworks 22 can be used for manipulating casing and/or drill pipe to be inserted into or removed from an oil well.

A rotary table 24 is positioned in the aft end region of the drilling module 12 so that it may be positioned directly over a well, and drill pipe or casing inserted therethrough. The rotary table 24 is, of course, positioned beneath a derrick (not shown) of the drilling rig. Preferably, the derrick is adapted for movement between horizontal and substantially upright positions on the drilling module 12 so that when the drilling module 12 is in a transport mode, the derrick may be lowered into its horizontal position, but raised into its substantially upright position when the drilling module 12 is located over the well site.

Additionally, electrical power is provided to the drilling module 12, pipe shelter 14, and mud module 16 via a conventional generator set 26. Preferably, the generator set 26 produces 480 V, 60 cycle AC power, which is delivered to an adjacent module or modules by a wiring harness arrangement described more fully in copending U.S. application Ser. No. 07/654,775, filed concurrently herewith.

The pipe shelter 14 and mud module 16 are configured in trailer-type arrangements, and are, thus, not self-powered and capable of being driven to the well site, but rather, are towed to the well site by a conventional tractor (not shown). At the well site, the pipe shelter 14 and drilling module 16 are positioned adjacent the drilling module 12, as shown in FIG. 1. The pipe shelter 14 and mud module 16 are positioned to avoid interference with existing well sites.

For example, the portable drilling apparatus 10 is specifically designed as a workover and well service rig to be used on an existing field on the North Slope of Alaska. In this field, the wellheads are positioned on a minimum 30 foot center, with 16 foot by 19 foot metal enclosures extending about each individual wellhead. Thus, the portable drilling apparatus 10 is preferably angularly positioned relative to the wellheads 26, 28, 30, 32 to provide sufficient room for the pipe shelter 14 and mud module 16 without interference from the therefore surrounding the wellheads 26, 28, 30, 32.

The process of positioning the portable drilling apparatus 10 begins by backing the drilling module 12 into position over the selected wellhead 30. Thereafter, the pipe shelter 14 and mud module 16 are trailered into position adjacent the drilling module 12. Preferably, the pipe shelter 14 is positioned adjacent the rotary table 24 so that the relatively bulky drill pipe and casing may be directly accessed by the drawworks 22 and hoisting apparatus mounted in the derrick, and moved into position over the rotary table 24.

The mud module 16, on the other hand, may be positioned more remote from the wellhead 30, owing to the somewhat easier transportability of the mud to be used in the well. For example, the mud module 16 includes all components for preparing the drilling mud, which is transferred into the well via a mud pump 34 located in the drilling module 12 and connected between the mud module 16 and wellhead 30 via appropriate piping (not shown). That is, the mud, while having a significant volume, is readily transported through the plumbing arrangement. On the other hand, the drill pipe and casing are rigid and can be quite lengthy and difficult to maneuver.

Operation of the mud module 16, while very important to the overall operation and success of the portable drilling apparatus 10, is only tangentially related to the instant invention, and, therefore, is not discussed in greater detail herein.

The pipe shelter 14 is a large, floored portable building, which is completely enclosed and substantially isolated from outside atmospheric conditions. The main purpose of the pipe shelter 14 is to house a substantial assemblage of drill pipe and/or casing so that it can be cleaned and warmed prior to insertion in the well. Thus, the pipe shelter 14 provides a desirable environment in which the drill pipe and casing may be temporarily stored, cleaned, and warmed while awaiting use in the well.

Ingress and egress of the drill pipe and casing is effected through a large opening 36 located in a front side wall 35 of the pipe shelter 14. The opening 36 is normally sealed against atmospheric intrusion by a door 38. The door 38 and opening 36 are of a size sufficient for receiving the longest length of drill pipe and/or casing expected to be used on a well site. For example, the door 38 and opening 36 are preferably approximately 45 feet in length and 6 feet 6 inches in height. Thus, a fork lift (not shown) may approach the opening 36 and door 38 with a load of drill pipe and/or casing thereon. The door 38 is opened and the drill pipe and/or casing is passed through the opening 36 and positioned on a set of pipe racks 40, 42. The lift truck then retreats and withdraws from the opening 36 so that the door 38 may be quickly shut to prevent large scale transfers of air between the pipe shelter 14 and air outside the pipe shelter 14.

Once the drill pipe and/or casing is positioned on the pipe racks 40, 42, workmen within the pipe shelter 14 clean the drill pipe and/or casing with conventional solvents. The drill pipe and/or casing is then transported across the pipe racks 40, 42 to a conventional pipe handler 44, which pivots the pipe and/or casing into a position to be transferred onto the drilling module 12 and used in the well.

The door 38 is preferably of a type that is readily adapted for high-speed operation and does not generate significant turbulence during the opening process. For example, swinging or barn-door type doors create significant turbulence that can result in a significant amount of arctic air being drawn into the pipe shelter 14. Garage type doors, on the other hand, do not generate significant turbulence, but are limited to relatively slow-speed operation by their multi-panel mechanical construction in combination with their frame constraints.

To minimize the loss of heated air from within the pipe shelter 14, the door 38 should be designed to open and close at as high a rate possible without damaging the pipe shelter 14 or the door 38 itself. Preferably, the door 38 is capable of moving at a preferred rate of approximately three feet per second and takes the form of a spool or window-shade type door. Thus, the door 38 is opened and closed by spooling it onto and off of a drum.

During the transfer of drill pipe and/or casing into the pipe shelter 14, the period of time that the door 38 is open can be separated into three different time periods: first, the period of time from when the door 38 first begins to open until it is fully open so that the fork-lift operator may insert the pipe and/or casing through the opening 36; second, the period of time while the forklift operator is inserting the drill pipe and/or casing into the pipe shelter 14; and third, the period of time after the forklift operator has withdrawn from the opening 36 and the door 38 is closing.

Thus, the loss of heated air may be most significantly affected by reducing the first and third time periods when no useful work is performed, but the door 38 is simply opening or closing. Therefore, the use of a high-speed electric motor for opening and closing the door in combination with a door design particularly adapted for high-speed operation results in a significant reduction in the amount of time that the door 38 remains open for each transfer of pipe and/or casing.

Preferably, a door designed for high-speed use is of the type generally described as a spool or window-shade style door. That is, the main components of the door 38 include: a flexible door member, a roller extending across the entire length of the opening 36, and a high-speed electric motor coupled to the roller and adapted to rotate the roller and thereby wind the flexible door member onto or off of the roller. Preferably, the door is of the type manufactured by M & I Door Systems, Ltd. under the tradename Re-Coil-Away System TM. The structure and operation of the Re-Coil-Away Door System TM is described below in conjunction with FIGS. 2–4.

Referring now to FIG. 2, a top, cross-sectional view of a door 50 and its support assembly 52 are shown. The door 50 is constructed from a relatively flexible sheet of rubber, which extends approximately 45 feet in width and more than 6 feet 6 inches in height. The door 50 has first and second longitudinal end portions 54, 56 that are substantially thicker than an intermediate portion 58. The enlarged construction of the end portions 54, 56 allows the support assembly 52 to capture these enlarged end portions 54, 56 and prevent substantial horizontal shifting of the door 50. Further, the support assembly 52 also interacts with the enlarged end portions 54, 56 to reduce air infiltration around the perimeter of the door by presenting a circuitous air flow path therearound.

The support structure 52 is formed from two major components: an L-shaped mounting bracket 60; and a modified L-shaped retaining bracket 62. Each end portion 54, 56 has associated with it substantially identical support assemblies 52. Therefore, identical element numbers have been used to identify each of the components of each of the support assemblies 52. The L-shaped mounting bracket 60 is coupled to an outside member 64 of the pipe shelter 14. Preferably, the mounting bracket 60 is attached to the outside wall member 64 by any conventional process, such as welding, riveting, screwing, etc.

The modified retaining bracket 62 is substantially L-shaped in configuration with one of its legs coupled to one of the legs of the mounting bracket 60. The other leg of the modified mounting bracket 62 extends substantially parallel with the door 58 for a first preselected distance, but then bends inward toward the door 58 for a second preselected distance, so that the enlarged end portions 54, 56 are captured within the cavity between the mounting bracket 60 and retaining bracket 62. While the retaining brackets 62 capture the door 58 against longitudinal movement, they still, of course, allow the door to move vertically within the cavity defined between the mounting and retaining brackets 60, 62.

FIG. 3 illustrates a perspective view of a portion of the support assembly 52 for the pipe shelter door 58 that includes a hinged coupling between the mounting and retaining brackets 60, 62. That is, a hinge 66 has a first end portion coupled to the mounting bracket 60 and a second end portion coupled to the retaining bracket 62. Thus, the retaining bracket 62 is free to rotate away from the mounting bracket 60. Preferably, the hinge 66 is spring loaded to urge the retaining bracket 62 into the position illustrated in FIGS. 2 and 3.

The hinge 66 allows simplified installation and removal of the door 58 from the cavity defined by the mounting and retaining brackets 60, 62. For example, during initial construction of the pipe shelter 14 and mounting of the entire door assembly, the mounting and retaining brackets 60, 62 are coupled to the outside wall member 64. The hinge 66 is opened so that the door 58 and, in particular, the enlarged end portions 54, 56 are readily inserted in the operating position adjacent the mounting bracket 60. Thereafter, the hinge 66 is closed, urging the retaining bracket 62 into the position illustrated in FIGS. 2 and 3 so as to retain the door 58 therein.

Additionally, the hinge 66 serves as a safety release device to allow the door 58 to swing away from its operating position in response to substantial contact with, for example, the forklift. In the event that the forklift operator inadvertently contacts the door 58 and forces it against the retaining bracket 62, the hinges 66 allow the retaining bracket 62 to pivot and free the door 58 to move inwardly. In this manner, the potential for substantial damage to the door 58 is reduced.

Turning now to FIG. 4, a side, cross-sectional view of the pipe shelter door assembly 36, 38, including a drive mechanism 68 is illustrated. The drive mechanism 68 includes a high speed electric motor 70 coupled through a conventional transmission 72 to a pulley 74. The pulley 74 drives a chain 76 that extends around a roller 78. The roller 78 extends substantially across the entire length of the opening 36 and is coupled to the top of the door 58. Thus, rotation of the electric motor 70 produces corresponding rotation of the pulley 74 and roller 78, thereby winding or unwinding the door 58 around the roller 78. Controlled rotation of the electric motor 70 in a first direction produces vertically upward movement of the door 58, while controlled rotation of the electric motor 70 in the second, opposite direction produces controlled downward vertical movement of the door 58.

The structural simplicity of the door 58 allows for relatively high-speed operation. For example, since the door 58 is a single unitary piece of rubberized material, there are no joints or discontinuities that may become engaged or jammed with the support assembly 52. Therefore, the electric motor 70 is selected to be a high-speed electric motor so that the speed at which the door 58 may be opened and closed is greatly enhanced, and the total time for which the door 58 is open during the transfer of drill pipe and/or casing is minimized.

Figure 5:
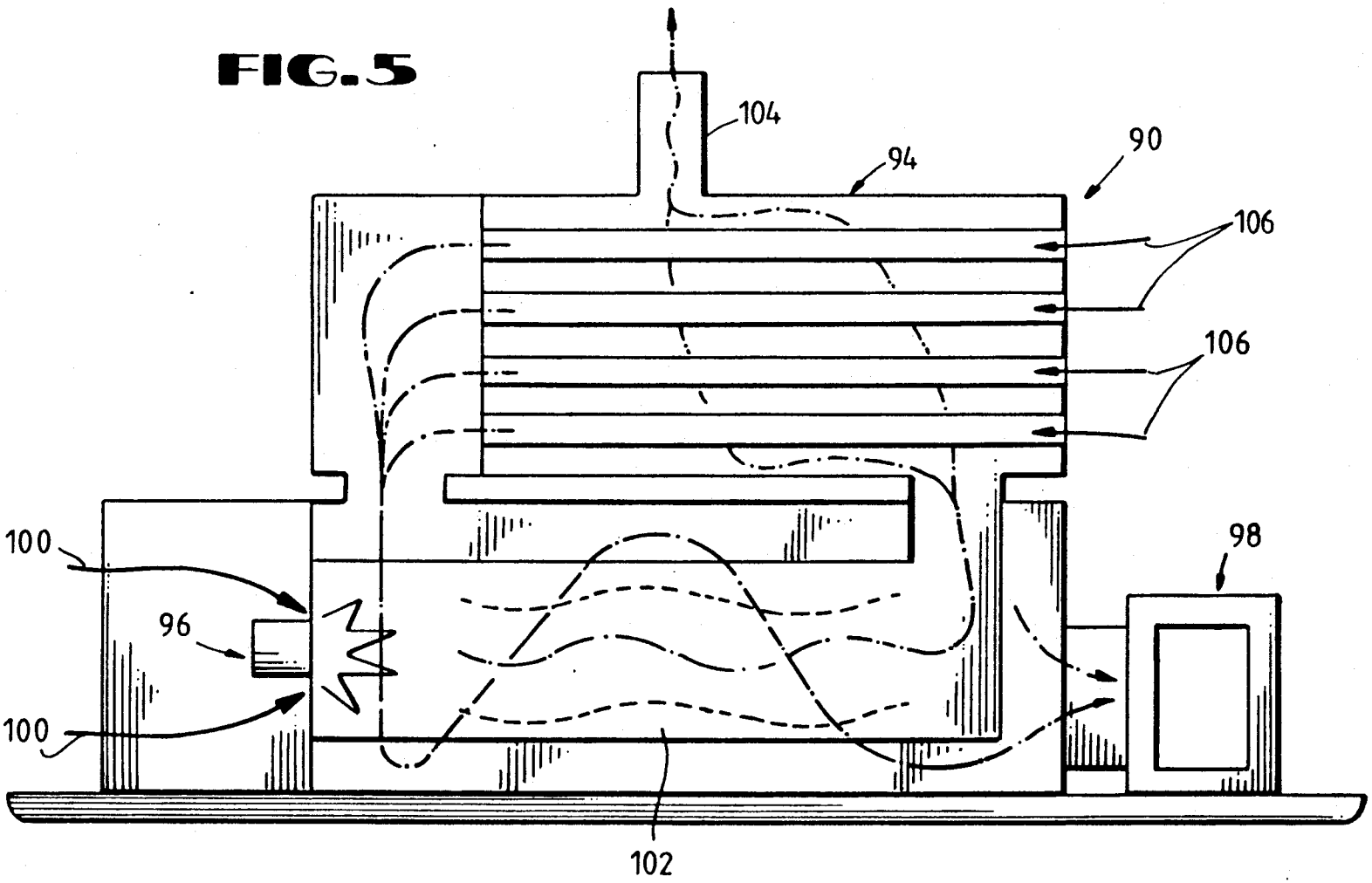
FIG. 5 illustrates a functional diagram of an indirect fired air heater.

Referring now to FIG. 5, a functional diagram of an indirect fired air heater 90 is illustrated. The indirect fired air heater 90 is also shown in FIG. 1 adjacent an end wall 92 and positioned to direct heated air into the enclosed space of the pipe shelter 14. Additionally, a system of conventional duct work (not shown) is used to distribute heated air from the indirect fired air heater 90 throughout the pipe shelter 14.

Preferably, the indirect fired air heater 90 takes the form of a model IDF-17A TM indirect fired air heater manufactured by Tioga Air Heaters, Inc., Tioga, N. Dak. Various models of indirect fired air heaters are available from Tioga Air Heaters, Inc., having a variety of BTU capacities and ACFM ratings. Selection of the IDF-17A TM is based primarily upon the cubic volume of the pipe shelter 14. For example, a significantly larger pipe shelter 14 would require an indirect fired air heater having both larger BTU per hour capacity and ACFM ratings.

The primary factor in sizing the indirect fired air heater 90 to the pipe shelter 14 is based upon the heaters ability to provide a positive pressure environment within the pipe shelter 14. That is, the air flow from the indirect fired air heater 90 should be sufficient to produce an atmospheric pressure within the pipe shelter 14 that is greater than the outside atmospheric pressure.

Owing to this pressure differential, when the door 38 is opened to admit pipe or casing to be loaded therein, the positive atmospheric pressure within the pipe shelter 14 forces heated air out through the opening 36 and reduces the inflow of cold outside air into the pipe shelter 14. Reduced inflow of cold outside air increases the comfort of the work force within the pipe shelter 14 and helps maintain the great temperature differential between the arctic outside air and the heated inside air.

Turning again to FIG. 5, the functional flow diagram of the indirect fired heater 90 is shown. The indirect fired heater 90 has as its main components a heat exchanger 94, a burner 96, and a fan discharge unit 98. The burner 96 can be configured to employ any conventional hydrocarbon fuel, such as natural gas, fuel oil, etc. The burner 96 is open to receive cold, outside air along a path generally indicated by the arrows 100. As the cold, outside air travels past the burner 96, it passes into a fire tube 102 where its temperature is substantially elevated. This heated outside air then migrates upward through the heat exchanger 94 and ultimately passes out through an exhaust stack 104.

At the same time, air from inside the pipe shelter 14 enters the heat exchanger along paths generally indicated by the arrows 106. During the passage of the inside air through the heat exchanger 94, its temperature is substantially elevated. A further increase in the temperature of the inside air is effected by circulating the inside air around the fire tube 102. Finally, the fan discharge unit 98 exhausts the now heated air back into the pipe shelter 14.

The fan discharge unit for the IDF-17A TM is designed to provide 17,000 cubic feet per minute of air. For the pipe shelter illustrated in FIG. 1, a 17,000 CFM air flow is sufficient to maintain a positive air pressure therein. It should be appreciated that pipe shelters of larger size may necessarily require a fan discharge unit having a higher CFM rating.

To control the temperature within the pipe shelter 14, the IDF-17A is controllably operable between high and low settings. The control of the heater 90 is effected by a conventional thermostat (not shown) that cycles the indirect fired air heater 90 between high and low heat output settings in response to the inside temperature falling below and rising above a preselected temperature, respectively.

To further decrease the time that the door 38 remains open, coordination between the approach of the lift truck and the opening of the door 38 is preferred. Advantageously, the Re-Coil-Away TM door 38 is equipped with a remote control transmitter and receiver pair (not shown) that allow for remote operation of the door 38. By locating the remote control transmitter on the lift truck, the operator is free to begin the opening process as he approaches the door 38. By carefully timing his approach, the operator of the lift truck can ensure that the door is open for the absolute minimum amount of time necessary to load the pipe and/or casing into the pipe shelter 14.

Although a particular detailed embodiment of the apparatus and method has been described herein, it should be understood that the invention is not restricted to the details of the preferred embodiment, and many changes in design, configuration, and dimensions are possible without departing from the spirit and scope of the invention.

I claim:

1. A method for controlling the temperature within a pipe shelter, comprising the steps of:

providing an opening in an outer wall of said pipe shelter for delivering material therethrough;

providing a high-speed spool or window-shade style door in said opening to substantially resist the exchange of air within said pipe shelter with air outside said pipe shelter;

pressurizing the interior of said pipe shelter with heated air to a level exceeding outside atmospheric pressure;

spooling said door open at high-speed;

delivering said material through said opening; and spooling said door closed at high-speed.

2. A method, as set forth in claim 1, wherein the step of pressurizing includes periodically heating the air in said pipe shelter with an indirect fired air heater, and providing a fan discharge unit to circulate said heated air at a rate sufficient to produce a positive pressure in said pipe shelter.

3. A method, as set forth in claim 2, wherein the step of heating said air includes cycling said indirect fired air heater between high and low heat output settings in response to said inside temperature falling below and rising above a preselected temperature, respectively.

4. A method, as set forth in claim 1, wherein the step of spooling said door open at high-speed includes winding said door onto a spool at approximately three feet per second.

5. A method, as set forth in claim 1, wherein the step of spooling said door closed at high-speed includes winding said door off of a spool at approximately three feet per second.

6. A method for controlling the temperature within a pipe shelter, wherein said pipe shelter includes an opening in an outer wall of said pipe shelter for delivering material therethrough, and a high-speed spool or window-shade style door in said opening to substantially resist the exchange of air within said pipe shelter with air outside said pipe shelter, the method comprising the steps of:

pressurizing the interior of said pipe shelter to a level exceeding outside atmospheric pressure, whereby air interior to said pipe shelter flows through said opening when said door is open, reducing the flow of outside air into said pipe shelter;

spooling said door open at high-speed;

delivering material through said opening;

spooling said door closed at high-speed.

7. A method, as set forth in claim 6, wherein the step of pressurizing includes periodically heating the air in said pipe shelter with an indirect fired air heater, and providing a fan discharge unit to circulate said heated air at a rate sufficient to produce a positive pressure in said pipe shelter.

8. A method, as set forth in claim 7, wherein the step of heating said air includes cycling said indirect fired air heater between high and low heat output settings in response to said inside temperature falling below and rising above a preselected temperature, respectively.

9. A method, as set forth in claim 6, wherein the step of spooling said door open at high-speed includes winding said door onto a spool at approximately three feet per second.

10. A method, as set forth in claim 6, wherein the step of spooling said door closed at high-speed includes winding said door off of a spool at approximately three feet per second.

11. A method for reducing the inward flow of outside air into a pipe shelter during a transfer of material therein that requires the opening and closing of a door on the pipe shelter, comprising the steps of:

pressurizing the interior of said pipe shelter with heated air to a level exceeding outside atmospheric pressure;

spooling said door open at high-speed;

delivering said material through said opening; and spooling said door closed at high-speed.

12. A method, as set forth in claim 11, wherein the step of pressurizing includes periodically heating the air in said pipe shelter with an indirect fired air heater, and providing a fan discharge unit to circulate said heated air at a rate sufficient to produce a positive pressure in said pipe shelter.

13. A method, as set forth in claim 12, wherein the step of heating said air includes cycling said indirect fired air heater between high and low heat output settings in response to said inside temperature falling below and rising above a preselected temperature, respectively.

14. A method, as set forth in claim 11, wherein the step of spooling said door open at high-speed includes winding said door onto a spool at approximately three feet per second.

15. A method, as set forth in claim 11, wherein the step of spooling said door closed at high-speed includes winding said door off of a spool at approximately three feet per second.

16. An apparatus for reducing the inward flow of outside air into a pipe shelter during a transfer of material through an opening in said pipe shelter, comprising:

a high-speed spool or window-shade style door positioned in said opening and adapted for substantially resisting the exchange of air within said pipe shelter with air outside said pipe shelter;

an indirect fired air heater adapted for periodically heating the air within said pipe shelter;

a fan discharge unit adapted for circulating said heated air at a rate sufficient to produce a positive pressure in said pipe shelter relative to atmospheric pressure outside said pipe shelter; and drive means coupled to said door and adapted for spooling said door open and closed at high-speed.

17. An apparatus, as set forth in claim 16, wherein said drive means is adapted for opening and closing said door at a rate of approximately three feet per second.

18. An apparatus, as set forth in claim 16, wherein said indirect fired air heater includes a thermostatic control adapted for cycling said indirect fired air heater between high and low heat output settings in response to said inside temperature falling below and rising above a preselected temperature, respectively.

19. An apparatus, as set forth in claim 16, wherein said drive means includes a roller extending substantially across said opening, and a high-speed electric motor rotatably coupled to said roller and adapted for rotating said roller in first and second opposite directions, and said door includes a sheet of rubberized material extending substantially across said opening and connected at one edge to said roller whereby rotation of said roller in said first direction urges said door to open by moving said door vertically upward, and rotation of said roller in said second direction urges said door to close by moving said door vertically downward.

* * * * *